US010051379B2

(12) United States Patent
Hui et al.

(10) Patent No.: US 10,051,379 B2
(45) Date of Patent: Aug. 14, 2018

(54) FILM SPEAKER

(71) Applicants: Yao Hui, Shenzhen (CN); Shujuan Li, Shenzhen (CN)

(72) Inventors: Yao Hui, Shenzhen (CN); Shujuan Li, Shenzhen (CN)

(73) Assignee: AAC TECHNOLOGIES PTE, LTD., Singapore (SG)

( * ) Notice: Subject to any disclaimer, the term of this patent is extended or adjusted under 35 U.S.C. 154(b) by 0 days.

(21) Appl. No.: 15/415,922

(22) Filed: Jan. 26, 2017

(65) Prior Publication Data

US 2018/0115832 A1 Apr. 26, 2018

(30) Foreign Application Priority Data

Oct. 26, 2016 (CN) ..... 2016 2 1173673 U

(51) Int. Cl.

| | |
|---|---|
| ***H04R 1/08*** | (2006.01) |
| ***H04R 9/08*** | (2006.01) |
| ***H04R 9/06*** | (2006.01) |
| ***H04R 1/24*** | (2006.01) |
| ***H04R 7/06*** | (2006.01) |
| ***H04R 7/18*** | (2006.01) |
| ***H04R 7/26*** | (2006.01) |
| ***H04R 9/02*** | (2006.01) |
| ***H04R 9/04*** | (2006.01) |

(52) U.S. Cl.

CPC ..... *H04R 9/06* (2013.01); *H04R 1/24* (2013.01); *H04R 7/06* (2013.01); *H04R 7/18* (2013.01); *H04R 7/26* (2013.01); *H04R 9/025* (2013.01); *H04R 9/046* (2013.01)

(58) Field of Classification Search

CPC ... H04R 2440/00–2440/07; H04R 1/08; H04R 9/08; H04R 11/04; H04R 17/02; H04R 21/02; H04R 2217/00–2217/03; H04R 19/00; H04R 19/01; H04R 19/013; H04R 19/016; H04R 9/048; H04R 7/04

USPC ..... 381/152, 171, 173, 176, 177, 190–191, 381/399, 431

See application file for complete search history.

(56) References Cited

U.S. PATENT DOCUMENTS 4,461,933 A * 7/1984 Chave ..... H04R 9/041 335/209
4,471,173 A * 9/1984 Winey ..... H04R 9/047 181/170
5,487,114 A * 1/1996 Dinh ..... H04R 9/00 381/406
6,108,433 A * 8/2000 Norris ..... G10K 9/13 367/140
6,373,958 B1 * 4/2002 Enomoto ..... B06B 1/0246 381/406

(Continued)

*Primary Examiner* — Suhan Ni
(74) *Attorney, Agent, or Firm* — Na Xu; IPro, PLLC

(57) ABSTRACT

A film speaker includes a metal foil; a diaphragm apart from and opposed to the metal foil; an elastomer for supporting the diaphragm; a voice coil disposed on the metal foil for producing magnetic field; and a damping member sandwiched between the voice coil and the diaphragm with two ends thereof abutting against the voice coil and the diaphragm respectively. The diaphragm includes a substrate layer and a magnetic material layer attached to a surface of the substrate layer for interacting with a magnetic field produced by the voice coil so as to drive the diaphragm to vibrate for generating sound.

11 Claims, 5 Drawing Sheets

(56) References Cited

U.S. PATENT DOCUMENTS

| | | | | |
|---|---|---|---|---|
| 6,519,347 | B1 * | 2/2003 | Morecroft | H04R 7/045<br>381/152 |
| 8,144,918 | B2 * | 3/2012 | Ikeda | H04R 7/045<br>381/152 |

* cited by examiner

FILM SPEAKER

FIELD OF THE PRESENT DISCLOSURE

The present disclosure relates to the technical field of electroacoustic transducers, and more particularly to a film speaker.

DESCRIPTION OF RELATED ART

Speakers are widely applied in people's daily life as a sound generator of electronic equipment. People are generally in pursuit of light and thin appearance design for smart products such as smart phones, smart watches, smart bands and tablets or notebook computers, so limited space is left for speakers.

In the related art, a moving-coil speaker is generally adopted in consumer electronic products, and common moving-coil speakers make a sound mainly through vibration of a diaphragm which is caused by the electromagnetic induction produced by a voice coil and a magnetic circuit system, with the operating principle that inserted in the magnetic gap formed by the magnetic circuit system, the voice coil produces electromagnetic induction with the magnetic circuit system as current passes through it, so that the voice coil makes reciprocating motion and drives the diaphragm to make reciprocating motion. In common moving-coil speakers, the magnetic circuit system occupies large space, and in order to enable the voice coil to drive the diaphragm to vibrate, adequate space must be provided for the voice coil to make reciprocating motion, so the thickness of the whole body is increased, not help to meet the demand for lighter and thinner consumer electronic products.

Thereof, it is necessary to disclose and provide an improved film speaker to overcome the above-mentioned disadvantages.

BRIEF DESCRIPTION OF THE DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figures and the embodiments. It should be understood the specific embodiments described hereby are only to explain this disclosure, not intended to limit this disclosure.

Figure 1:
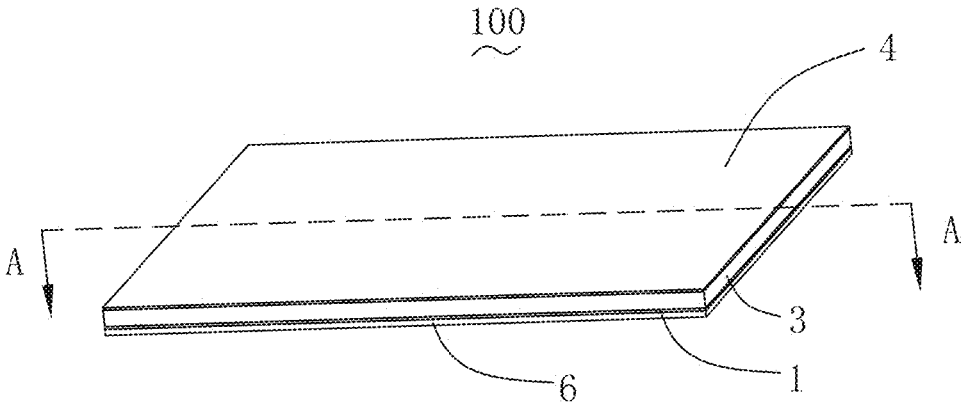
FIG. 1 is an isometric view of a film speaker in accordance with an exemplary embodiment of the present disclosure.
Figure 2:
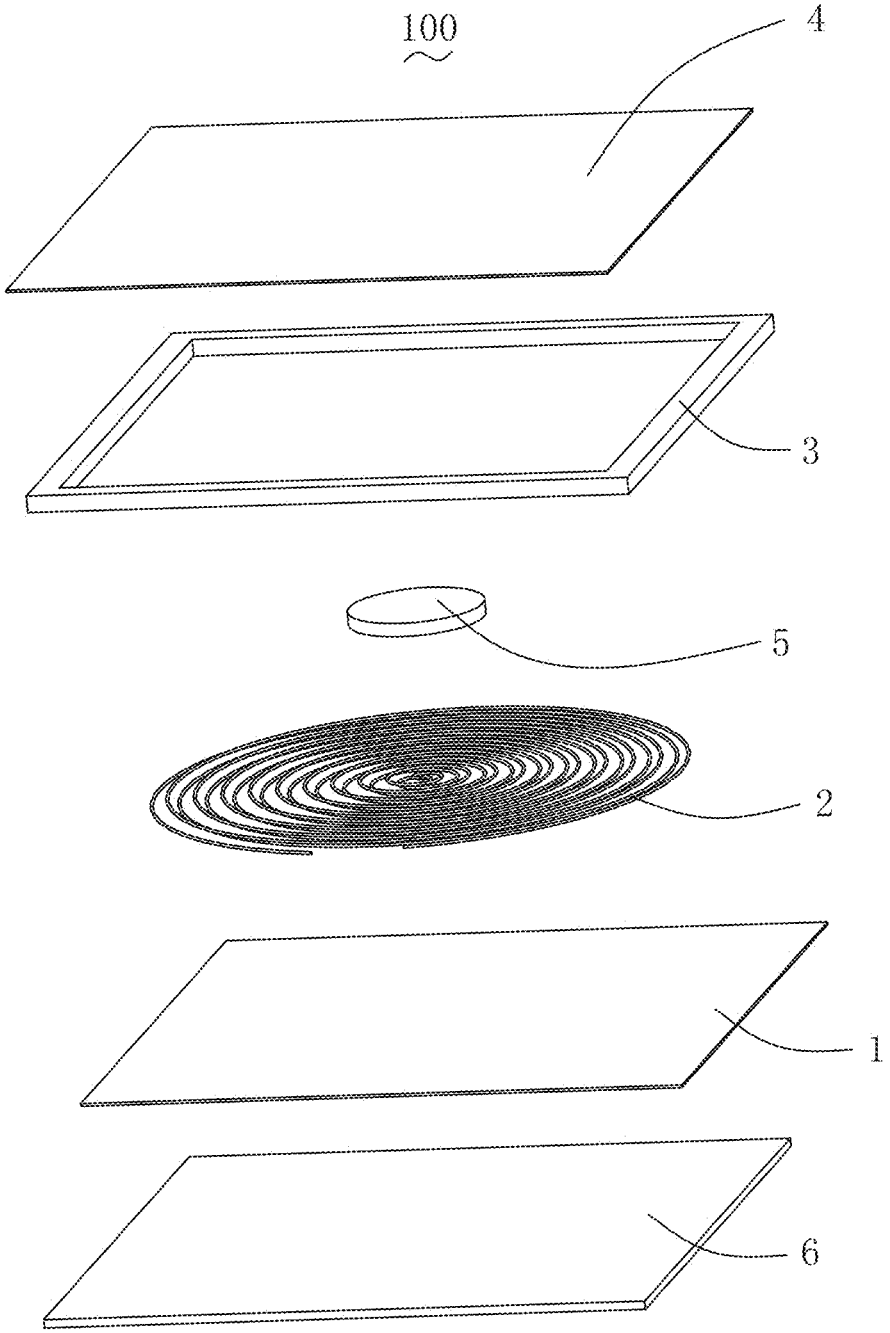
FIG. 2 is an exploded view of the film speaker in FIG. 1.
Figure 3:
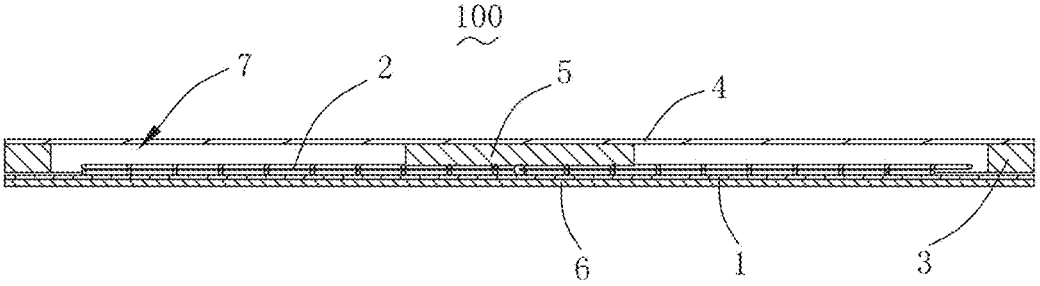
FIG. 3 is a cross-sectional view of the film speaker, taken along Line A-A in FIG. 1.

Referring to FIGS. 1-3, a film speaker 100 in accordance with an exemplary embodiment of the present disclosure comprises a metal foil 1, a voice coil 2, an elastomer 3, a diaphragm 4, a damping member 5, and a supporting plate 6. The elastomer 3 is disposed between the metal foil 1 and the diaphragm 4 along a vibration direction of the diaphragm 4. The elastomer 3 is stacked on the metal foil 1, and the diaphragm 4 is stacked on the elastomer 3. The elastomer 3 is supported by the metal foil 1, and the diaphragm 4 is further supported by the elastomer 3 for forming an accommodation space 7, and the voice coil 2 is arranged in the accommodation space 7 and is spaced apart from the diaphragm 4. The voice coil 2 will be electrified to generate magnetic field for driving the diaphragm 4 to make reciprocating motion. In this embodiment, the metal foil 1 is an iron foil. In fact, other magnetic conduction materials are also feasible to achieve the function as the iron foil.

The metal foil 1 is disposed on the supporting plate 6. In fact, the metal foil 1 could also be indirectly attached to the supporting plate 6 via a medium like a gasket, a block or other component. The purity of the metal foil is optionally up to 99.99%, because high-purity metal foils have better flexibility in control of magnetic fields. The voice coil 2 is fixed on the metal foil 1.

The elastomer 3 is arranged on an edge of the supporting plate 5; and cooperatively forms a sealed cavity (the accommodation space 7) together with the diaphragm 4 and the metal foil 1. When the diaphragm 4 vibrates upward or downward, the volume of the sealed cavity is increased or decreased accordingly, thereby forming a pressure difference between the inside and the outside of the cavity, which produces a restoring force to the diaphragm 4.

Figure 4:
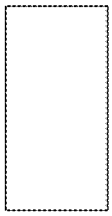
FIG. 4 is an illustration of an elastomer of the film speaker.
Figure 5:
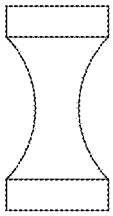
FIG. 5 is an illustration of an alternative elastomer of the film speaker.
Figure 6:
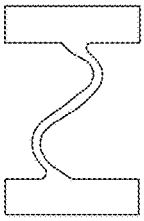
FIG. 6 is an illustration of another alternative elastomer of the film speaker.
Figure 7:
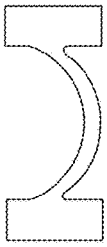
FIG. 7 is an illustration of another alternative elastomer of the film speaker.

Referring to FIGS. 4-7, some embodiments of the elastomer 3 are shown. As shown in FIG. 4, the elastomer 3 is has a rectangular cross section. As shown in FIG. 5, the elastomer 3 has an elastic arm having a thinner waist for increasing the resilience of the elastomer 3. As shown in FIG. 6, the elastomer 3 has an elastic s-shaped arm for increasing the resilience of the elastomer 3. As shown in FIG. 7, the elastomer 3 has an elastic c-shaped arm for increasing the resilience of the elastomer 3.

The shape of the elastomer 3 could be changed due to actual design demands. Wherein, for high-frequency vibration units, the strips made of elastic material for forming the elastomer 3 may have a square or H-shaped cross section that becomes narrower from both ends to the middle; for low-frequency units, the cross section of the strips made of elastic material for forming the elastomer 3 may have an S shape in the middle, making the elastomer 3 has less stiffness; for intermediate or wide-frequency vibration units, the cross section of the strips made of elastic material forming the elastomer 3 may take a C shape. In other embodiments, the elastomer 3 can be made integral by injection molding.

The elastomer 3 can be made from foam, composite material of constrained damping structure or doped composite material. When the elastomer 3 is be made from foam, it can not only adjust the vibration elasticity of the generating plane, but also increase the overall flexibility of the film speaker 100 to better play its advantage of flexibility; for intermediate and high-frequency speaker, the circular elastomer 3 can be made from composite material of constrained damping structure or doped composite material (such as thermoplastic elastomer doped with petroleum resin).

Figure 8:
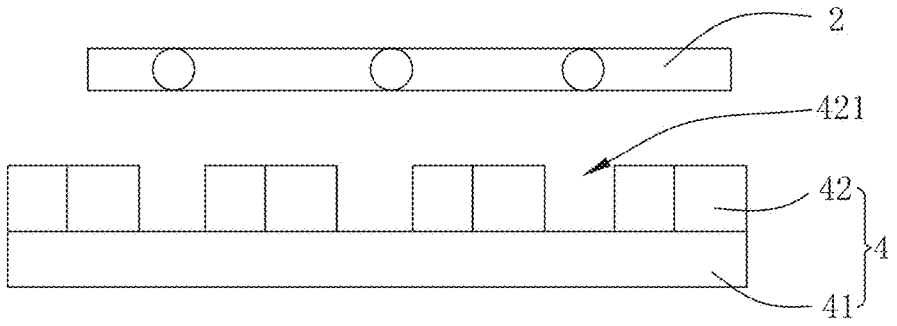
FIG. 8 is an illustration showing the relationship of a diaphragm and a voice coil of the film speaker.

Referring to FIG. 8, the diaphragm 4 is used for generating sound by vibration, comprising a substrate layer 41 and a magnetic material layer 42 formed on the surface of the substrate layer 41. The magnetic material layer 42 of the diaphragm 4 enables interacting with the magnetic field generated by the voice coil 2 after being electrified, thereby the diaphragm 4 is activated to vibrate due to the interaction between the magnetic material layer 42 and the magnetic field generated by the voice coil.

The substrate layer 41 can be flexible substrate film or stiff substrate film, wherein the flexible substrate film is a PEK polymer layer; the stiff substrate film is a thin layer of metal, oxide or alloy.

The magnetic material layer 42 is a metal magnetic material layer, could be composed by a mixture of multiple elements such as iron, Neodymium, boron, cobalt, and its compounding ratio can be adjusted according to actual design demand.

The magnetic material layer 42 is arranged oppositely spaced apart from the voice coil 2, and the magnetic material layer 42 forms a plurality of magnetic gaps 421. Along the vibration direction of the diaphragm 4, a projection of the voice coil 2 on the magnetic material layer 42 is located in the magnetic gaps 421, so as to improve the vibration efficiency of the first diaphragm 4 being driven by the voice coil 2.

Apart from the embodiments above, the relative position of the substrate layer 41 and the magnetic material layer 42 may be adjusted, for example, arranged so that the substrate layer 41 is oppositely spaced apart from the voice coil 2 in such a way that the diaphragm 4 has a magnetic property and vibrates under the driving of the magnetic field generated upon energization of the voice coil 2.

The damping member 5 is sandwiched between the voice coil 2 and the diaphragm 4, with two ends abutting against the voice coil 2 and the diaphragm 4 respectively. The damping member 5 is located at a center of the voice coil 2. The damping member 5 can be made from foam and the damping member 5 has a compression ratio of 10%-80% at vibration condition. Polyester foam, elastomer foam or silica gel foam can be selected to be used for the damping member 5, foam of other material can also be alternatively used. The damping member 5 has a certain compression ratio at vibration condition.

Figure 9:
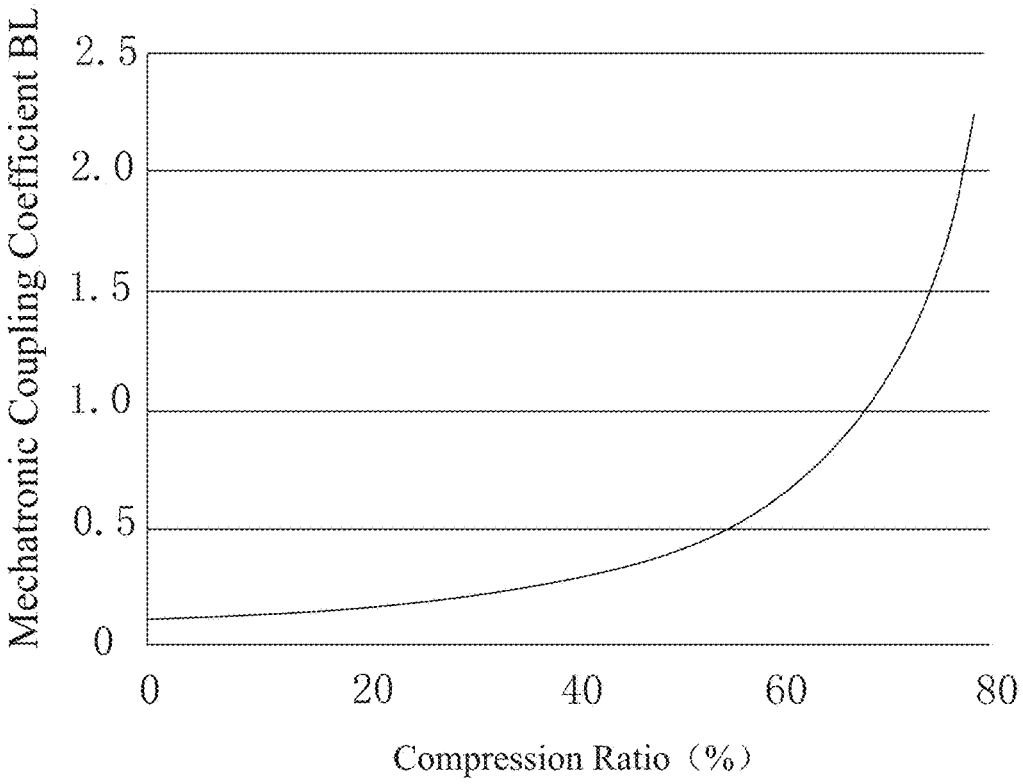
FIG. 9 shows a relationship between a compression ratio and a mechatronic coupling coefficient BL of a damping member of the film speaker.
Figure 10:
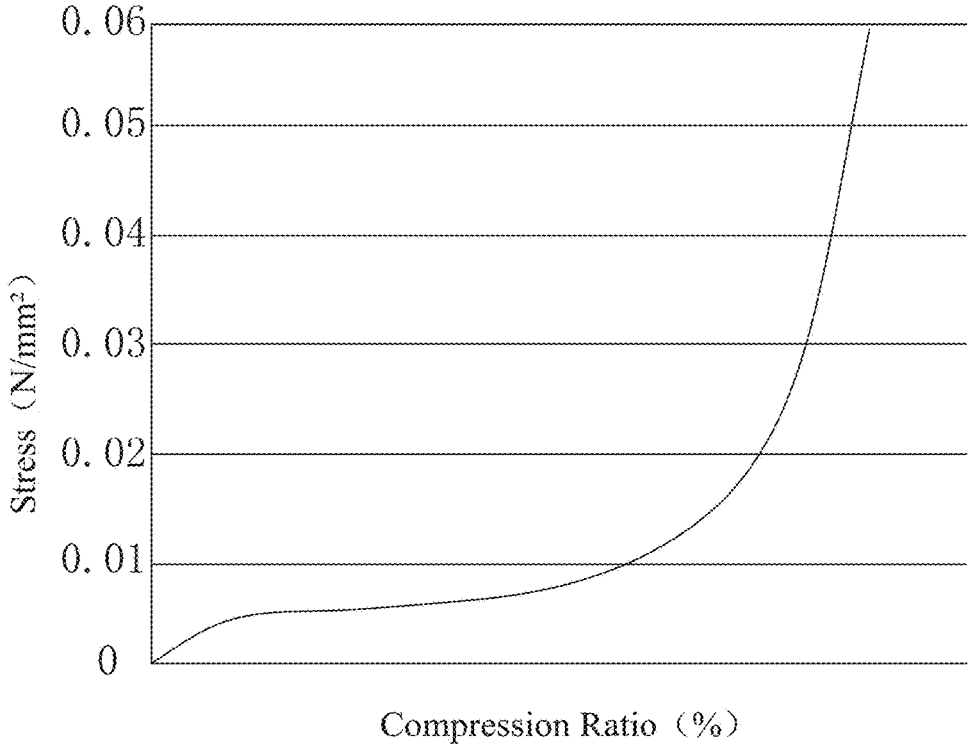
FIG. 10 shows a relation between the compression ratio and a stress of the damping member in the film speaker.

Taking the material of the damping member 5 as an example, the influence of the damping member 5 on the performance of the film speaker 100 is described hereafter. Referring to FIGS. 9-10, when the compression ratio of the foam is in the range of 10-80%, the mechatronic coupling coefficient BL of the film speaker 100 increases with the increase in compression ratio, and the stress upon the foam also increase with it; and under different conditions of compression ratio, the ratio of mechatronic coupling coefficient BL and the stress is a fixed value, so that the vibration stiffness of the film speaker 100 and BL value can be coordinated with the change in amplitude, thus ensuring the vibration linearity to control distortion of the film speaker effectively.

The speaker disclosed in the present utility model has the following beneficial effects compared with the related art: I. The voice coil 2 generate a magnetic field upon energization, the metal foil 1 is magnetized as soft magnetic material, intensifying the magnetic force of the voice coil 2 and producing gravitation and repulsion to the diaphragm 4 with magnetic material layer to cause the diaphragm 4 make reciprocating motion. Therefore, the space occupied by the magnetic circuit system and the voice coil in the related art can be omitted, effectively reducing the thickness of speakers and meeting the design demand of lighter and thinner electronic products.

Further, the film loudspeaker 100 comprises the damping member 5 which is arranged between the voice coil 2 and the diaphragm 4 with each end abutting on the voice coil 2 and the diaphragm 4 respectively. The damping member 5 has good stiffness adjustment ability, so that the vibration stiffness and BL value can be well coordinated with the change in amplitude, thus controlling distortion of the film speaker effectively.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A film speaker, including:

a metal foil;

a diaphragm apart from and opposed to the metal foil;

an elastomer for supporting the diaphragm, the elastomer disposed between the metal foil and the diaphragm along a vibration direction of the diaphragm, the elastomer stacked on the metal foil, the diaphragm stacked on the elastomer, an accommodation space formed by the elastomer cooperatively with the diaphragm and the elastomer;

a voice coil arranged in the accommodation space and disposed on the metal foil for producing magnetic field;

a damping member sandwiched between the voice coil and the diaphragm with two ends thereof abutting against the voice coil and the diaphragm respectively;

wherein the diaphragm comprises a substrate layer and a magnetic material layer attached to a surface of the substrate layer for interacting with the magnetic field produced by the voice coil so as to drive the diaphragm to vibrate for generating sound.

2. The film speaker as described in claim 1 further comprising a supporting plate for carrying the metal foil, the metal foil is disposed on the supporting plate.

3. The film speaker as described in claim 1, wherein the metal foil has a plurality of damping holes.

4. The film speaker as described in claim 1, wherein the metal foil is an iron foil.

5. The film speaker as described in claim 1, wherein the magnetic material layer includes a plurality of magnetic gaps, and a projection of the voice coil along a vibration direction of the diaphragm on the magnetic material layer is located in the magnetic gaps.

6. The film speaker as described in claim 5, wherein the voice coil is a flat coil.

7. The film speaker as described in claim 6, wherein the voice coil is fixed to the metal foil by bonding.

8. The film speaker as described in claim 1, wherein, a cross section of the elastomer is a rectangle, a C shape, an S shape, an H shape, or a thinner waist.

9. The film speaker as described in claim 1, wherein the damping member is made of foam.

10. The film speaker as described in claim 1, wherein a compression ratio of the damping member under vibration is 10%~80%.

11. The film speaker as described in claim 1, wherein the damping member is disposed at a center of the voice coil.

* * * * *